US006099177A

United States Patent [19]

Ito

[11] Patent Number: 6,099,177

[45] Date of Patent: Aug. 8, 2000

[54] ENGRAVING HEAD

[75] Inventor: Tomoo Ito, Tokyo, Japan

[73] Assignee: Ando Electric Co., Inc., Tokyo, Japan

[21] Appl. No.: 09/378,921

[22] Filed: Aug. 23, 1999

[30] Foreign Application Priority Data

Aug. 24, 1998 [JP] Japan ..... 10-237793

[51] Int. Cl.[7] ..... B41J 1/58

[52] U.S. Cl. ..... 400/132; 30/164.9; 101/3.1

[58] Field of Search ..... 400/118.1, 118.2, 400/118.3, 127, 129, 132; 101/3.1, 4, 12, 13, 18, 19, 26; 30/164.9

[56] References Cited

U.S. PATENT DOCUMENTS

| | | | |
|---|---|---|---|
| 3,384,965 | 5/1968 | Sickling | 30/164.9 |
| 5,368,400 | 11/1994 | Cyphert et al. | 400/127 |
| 5,785,436 | 7/1998 | Harrison et al. | 400/120.01 |
| 5,823,691 | 10/1998 | Langner | 400/127 |

*Primary Examiner*—Christopher A. Bennett

*Attorney, Agent, or Firm*—Pillsbury Madison & Sutro LLP

[57] ABSTRACT

An engraving head that includes a movement mechanism for moving an engraving stylus within the body housing of the engraving apparatus is provided. The movement of the engraving stylus causes the tip of the engraving stylus to approach and recede from an engraving surface. The movement mechanism contains a movable body and a first energizing means. The movable body moves in association with a movement space member's inner circumference. The movement space member is positioned inside the body housing. The first energizing means is employed to energize the movable body in a direction away from the engraving surface. Additionally, a second energizing means serves to energize the movable body in a direction towards the engraving surface against the opposing energizing force of the first energizing means. The second energizing means may be, for example, compressed gas. As the movable body travels downward towards the engraving surface, the tip portion of the engraving stylus also approaches the engraving surface. When the energizing force of the second energizing means is released or is less than a predetermined value, the movable body and the tip portion of the engraving stylus recede from the engraving surface.

11 Claims, 3 Drawing Sheets

*FIG.3* (PRIOR ART)
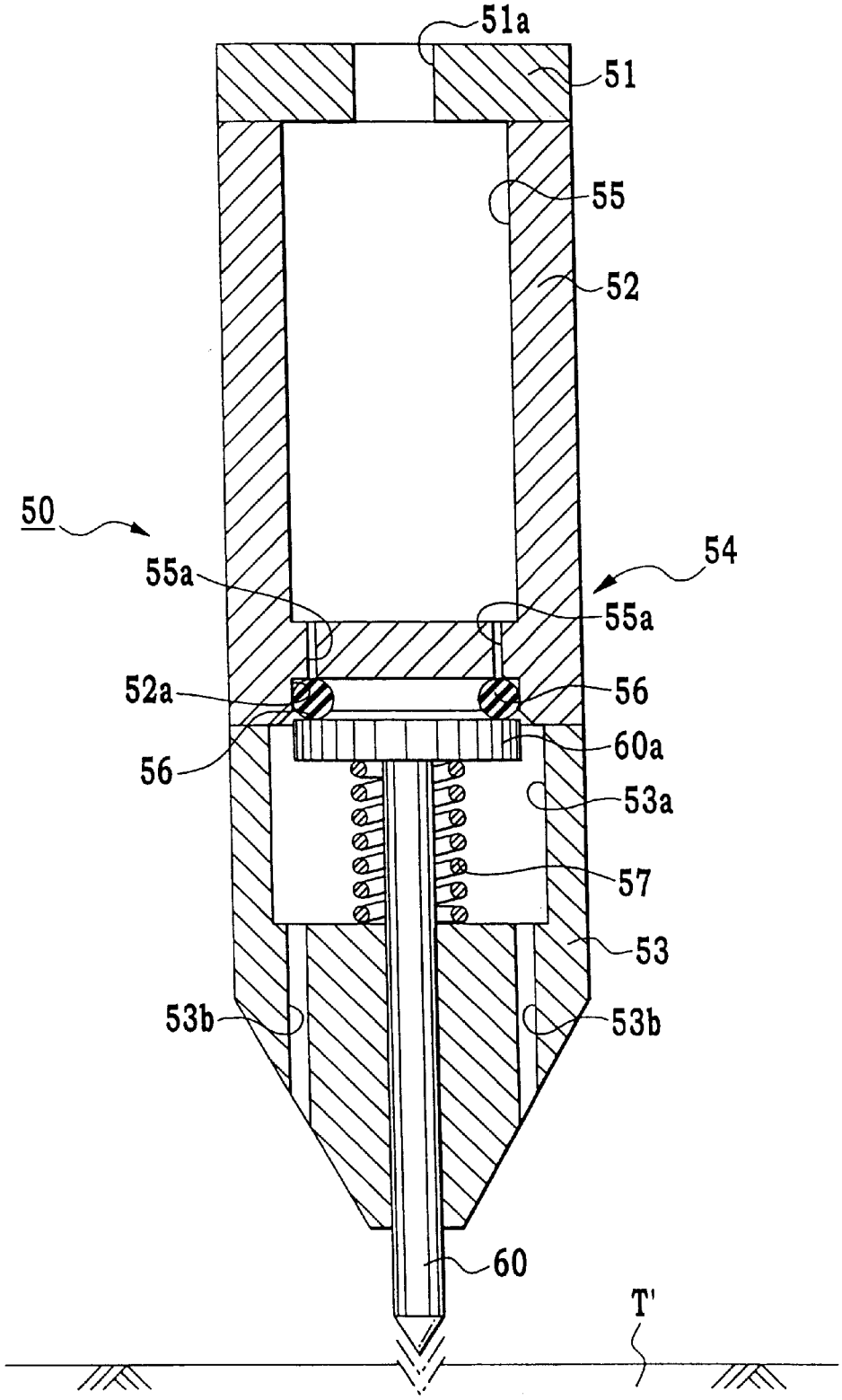

ENGRAVING HEAD

FIELD OF THE INVENTION

The invention relates to the field of engraving instruments, and more particularly to an engraving head used in conjunction with an engraving apparatus to engrave, for example, letters, symbols or figures on the surface of an engraving work piece.

BACKGROUND OF THE INVENTION

The preexisting technology will be discussed in reference to FIG. 3. As shown in FIG. 3, an engraving head 50 comprises a body housing that includes an end portion 52 and a top portion 53 that are joined together. Cap 51 attaches to the upper portion of end portion 52. The body housing 54 mounts to an engraving apparatus (which is not shown) and moves in X and Y directions by a movement means attached to the engraving apparatus (which is not shown). In addition the prior art contains an up-and-down movement means (which is not shown) that moves body housing 54 upward and downward. The up-and-down movement means may be an air cylinder, a sliding mechanism or the like. The up-and-down movement means couples to the engraving head 50.

The body housing 54 includes a vibration generating mechanism used in conjunction with compressed gas to cause engraving stylus 60 to vibrate slightly up and down. The vibration generation mechanism will be discussed below. A compressed gas supply port 51*a* is provided on cap 51. The compressed gas supply port 51*a* continuously supplies the compressed gas to inner room 55 of the end portion 52. The compressed gas enters inner room 55 and flows downward through penetrating holes 55*a* and encounters O-ring 56. The introduction of the compressed gas increases the gas pressure within inner room 55. (As the volume of the compressed gas increases within inner room 55, the pressure of the gas increases.)

When the gas pressure applied to O-ring 56 is less than a predetermined value, O-ring 56 is energized upward. The coils of helical compression spring 57 extend upward generating an upward movement of flanged portion 60*a* and O-ring 56. O-ring 56 is energized upward to cover penetrating holes 55*a,* which are formed at the lower end of end portion 52. As the gas flows into inner room 55, the pressure increases and energizes O-ring 56 downward.

When the gas pressure applied to O-ring 56 exceeds a predetermined value, engraving stylus 60, O-ring 56 and flanged portion 60*a* are energized downward against the energizing force of helical compression spring 57. This downward motion of O-ring 56 creates small spaces between O-ring 56 and O-ring containing groove 52*a.* These small spaces permit the compressed to pass into the engraving stylus operating room 53*a* of top portion 53. After entering engraving stylus operating room 53*a,* the compressed gas flows through a pair of discharge holes 53*b* and exits top portion 52.

As the compressed gas exits, the pressure decreases within engraving head 50, and the gas pressure applied to O-ring 56 falls below the predetermined value. Once again, O-ring 56 and engraving stylus 60 are energized upward. Due to the decreased pressure, helical compression spring 57 expands upward generating an upward movement of flanged portion and O-ring 56. O-ring 56 is energized upward to cover penetrating holes 55*a.* As previously discussed, the gas pressure inside inner room 55 increases again.

The introduction of the compressed gas generates the intermittent expansion and contraction motion of the helical compression spring, which in turn causes O-ring 56 and engraving stylus 60 to slightly vibrate up and down.

During the vibration of engraving stylus 60, the up-and-down movement means (which is not shown) guides and lowers the entire engraving head 50 to press the tip of engraving stylus 60 against an engraving surface T'. The up-and-down movement means may be an air cylinder, a sliding mechanism or the like. Then, the engraving head 50 is moved in the X and Y directions by the movement means to engrave letters, symbols, figures or the like on the engraving surface T'.

In order to produce engravings that are not expressed with a single brush stroke on an engraving surface, the engraving apparatus of the prior art must stop engraving, the up-and-down movement means lifts the entire engraving head 50 and the movement means repositions according to the desired X and Y coordinates. Next, engraving head 50 is moved downward at a predetermined position and the engraving procedure is resumed.

In order to press the tip of engraving stylus 60 against engraving surface T' during engraving and to perform engravings that are not expressed with a single brush stroke on the engraving surface, the prior art requires that the engraving apparatus includes an up-and-down movement means. The addition of the up-and-down movement means increases the cost and the size of the engraving apparatus. Furthermore, the repetitive operations needed to perform engravings that are not expressed with a single brush stroke on the engraving surface is time consuming. As discussed above, the prior art requires that the engraving apparatus pauses the engraving process so that the up-and down movement means may move the whole engraving head 50 upward. Then, engraving stylus 60 is moved in the X and Y directions to a predetermined position. Thereafter, the engraving head 50 is once again lowered to engraving surface T'. This repetitive process is time consuming.

SUMMARY OF THE INVENTION

A general object of this invention is to overcome these and other drawbacks of prior art engraving devices.

An object of the invention is to provide an engraving head that produces engraving which are not expressed with a single brush stroke on a engraving surface. Another object of the invention is to provide an engraving head that does not require an up-and-down movement means, such as a sliding mechanism or an air cylinder.

According to one embodiment of the invention, the engraving head comprises: a means for moving the engraving head in a plane that is parallel to an engraving surface of a work piece to be engraved; an engraving stylus partially disposed within a body housing, the engraving stylus is capable of slightly vibrating and striking its tip portion against the engraving surface to form a recess in the engraving surface; and a movement mechanism for moving the engraving stylus within the body housing as the tip portion of the engraving stylus is extended to and withdrawn from the engraving surface. The engraving stylus of the present invention can be positioned within the body housing at a predetermined position. Thereafter, the engraving stylus can begin to slightly vibrate.

Accordingly, the engraving head is moved to the desired engraving position by a movement means that moves the engraving head in a plane that is parallel to the engraving surface of the work piece to be engraved. Then, the engraving stylus is moved within the body housing of the engraving head by the movement mechanism, so that the tip of the engraving stylus approaches the engraving surface. During the slight vibrations of the engraving stylus, the tip portion thereof strikes against the engraving surface to form a recess or a cavity therein. Simultaneously, the engraving head is moved in the plane which is parallel to the engraving surface to produce engravings, such as letters, symbols, figures or the like in the engraving surface.

In order to perform engravings that are not expressed with a continuous recess, in order words, engravings which are not expressed with a single brush stroke on the engraving surface, the following procedure is followed. Once the engraving stylus is moved within the body housing by the movement mechanism so that the tip portion of the engraving stylus recedes from the engraving surface, the movement means positions the engraving head to a desired position. Then, the movement mechanism positions the tip portion of the engraving stylus near the engraving surface. As the engraving stylus vibrates, the movement means moves the engraving head in a plane that is parallel to the engraving surface, thus, producing engravings.

In summary, the present invention does not require the addition of an up-and-down movement means that lifts the entire engraving head during the engraving process since the engraving stylus moves within and relative to the engraving head so that the tip portion of the engraving stylus approaches and recedes from the engraving surface. Accordingly, for example, it is not required for the engraving apparatus to be provided with an up-and-down movement means, such as a sliding mechanism or air cylinder, that guides the up-and-down movement of the entire engraving head. Thus, the present invention discloses a cheaper and a more compact engraving device.

The present invention provides an engraving head that includes a movement mechanism for moving an engraving stylus within the body housing of the engraving apparatus. The movement of the engraving stylus causes the tip of the engraving stylus to approach and recede from an engraving surface. The movement mechanism contains a movable body and a first energizing means. The movable body moves in association with a movement space member's inner circumference. The movement space member is positioned inside the body housing. The first energizing means is employed to energize the movable body in a direction away from the engraving surface. Additionally, a second energizing means serves to energize the movable body downward towards the engraving surface against the opposing energizing force of the first energizing means. The second energizing means may be, for example, compressed gas. As the movable body travels downward towards the engraving surface, the tip portion of the engraving stylus also approaches the engraving surface. When the energizing force of the second energizing means is released or is less than a predetermined value, the movable body and the tip portion of the engraving stylus recede from the engraving surface. Therefore, the engraving stylus can be easily and quickly maneuvered within the body housing by the movement mechanism, as the tip portion approaches and recedes from the engraving surface.

Furthermore, the energizing force of the first and the second energizing means may be adjusted so that the movement of the engraving stylus may be rapidly performed. Likewise, if compressed gas is used as the second energizing means, the gas pressure and the flow rate of the gas may be adjusted as needed to energize the movable body to and from the engraving surface. This feature also enhances the rapid movement of the tip portion towards the engraving surface as the movable body moves downward.

A pair of penetrating holes are provided within the movable body. The penetrating holes may permit the compressed gas to pass through the movable body and enter the top portion of the body housing when the second energizing means is activated. A flanged portion couples to one end of the engraving stylus. At least one or more elastic members serves to cover the exit of the penetrating holes. The elastic member is disposed between the flanged portion and the movable body in a position that prevents the elastic member from shifting to the movable body. As the compressed gas intermittently passes between the exit of the penetrating holes and the elastic member, slight vibrations are generated.

According to the invention, the power of the compressed gas can be utilized to simultaneously move the tip portion of the engraving stylus towards the engraving surface and to generate the slight vibrations of the engraving stylus. Further, the elastic member can be positioned and disposed in a groove portion formed in the movable body so that the elastic member is prevented from shifting to the movable body.

In accordance with another embodiment of the present invention, the engraving head may comprise a body housing, an engraving stylus and a movement mechanism. The body housing mounts to an engraving apparatus having means for moving the engraving head in a plane that is perpendicular to the engraving head. The body housing contains the engraving stylus, which vibrates with a small amplitude. The movement mechanism moves the engraving stylus within the body housing to extend and contract the tip portion of the engraving stylus. With the engraving head, the engraving stylus can be moved relative to the body housing. The engraving stylus can be extended from the body housing by the movement mechanism, and the engraving stylus can be positioned within the body housing at a predetermined position, which is determined by a lower limiting surface. Thereafter, the engraving stylus can vibrate with a small amplitude causing the tip portion thereof to strike against the surface of an engraving work piece. After the engraving stylus stops vibrating, the engraving stylus can be contracted within the body housing by the movement mechanism. Then, the engraving stylus can be positioned within the body housing at another predetermined position, which is determined by an upper limiting surface. Then, the movement means may relocate the engraving stylus to another engraving position.

BRIEF DESCRIPTION OF THE DRAWINGS

The features, objects and advantages of the present invention will become more apparent from the detailed description set forth below when taken in conjunction with the drawings in which like reference characters identify correspondingly throughout and wherein:

FIG. 3 is a sectional side view of a prior art engraving device.

DETAILED DESCRIPTION OF THE PREFERRED EMBODIMENTS

Figure 1:
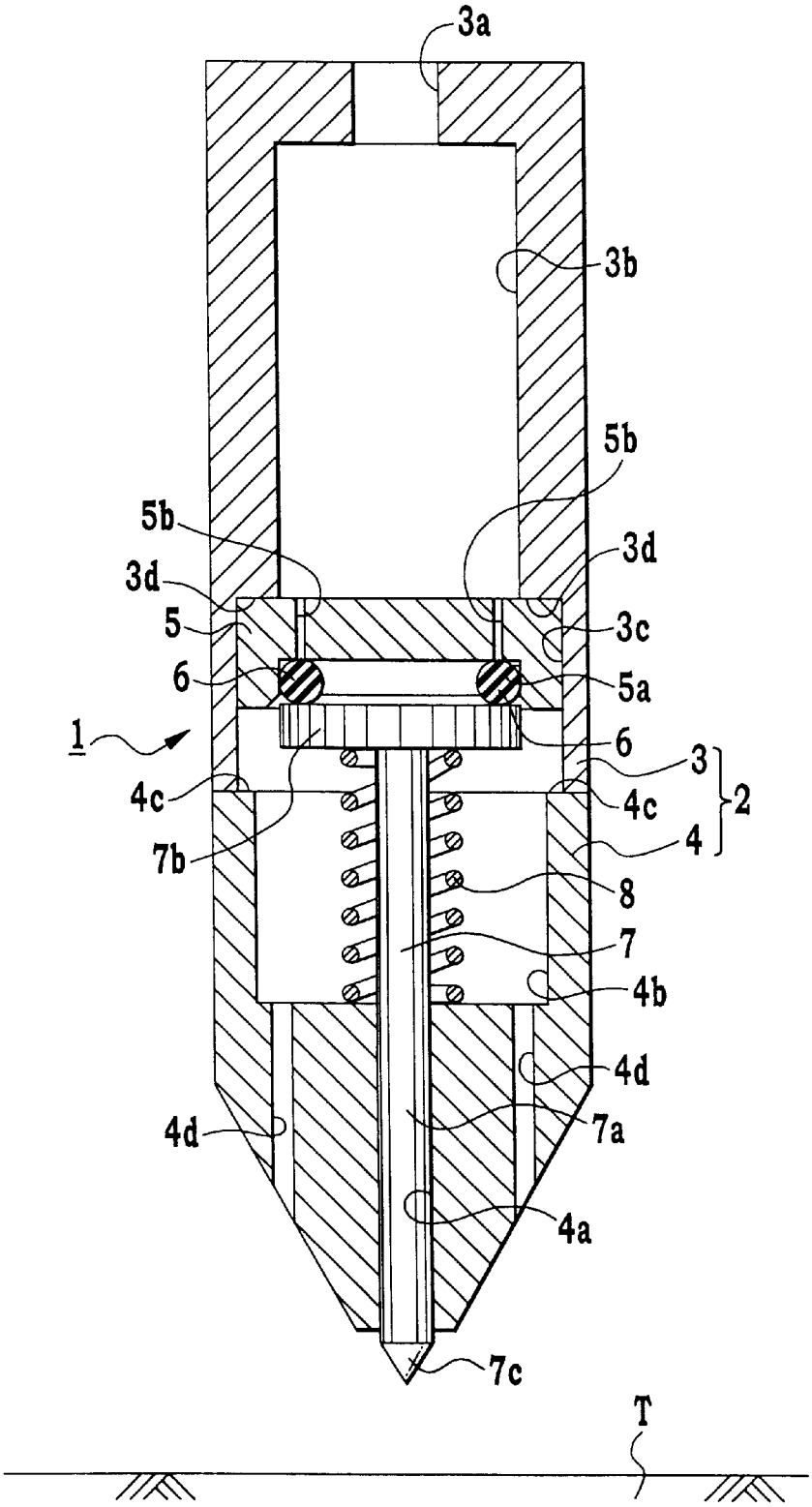
FIG. 1 is a sectional side view of the engraving head in accordance with an embodiment of the present invention.

One embodiment of the invention relates to an engraving head 1 as shown in FIG. 1. In FIG. 1, engraving head 1 is provided with a body housing 2. Body housing 2 is principally comprised of four major elements, namely, end portion housing 3, top portion 4, an engraving stylus 7, and a movement mechanism. Top portion 4 connects to end portion housing 3. The movement mechanism includes a movable body 5 and a helical compression spring 8.

The body housing 2 mounts to an engraving apparatus (which is not shown) and moves in the X and Y directions by a movement means (which is not shown). The movement means attaches to the engraving apparatus. The body housing 2 may be moved by the movement means if, for example, in a plane that is perpendicular to the body housing 2 or in a plane that is parallel to an engraving surface T of a workpiece to be engraved.

The end portion housing 3 contains a compressed gas supply port 3*a,* an inner room 3*b* and a cylindrical movement space 3*c,* which connects to inner room 3*b.* The compressed gas introduced by the compressed gas supply port 3*a* functions as a second energizing means as it flows from the compressed gas supply port 3*a* and into inner room 3*b.*

A cylindrical movable body 5 is slidably disposed inside movement space 3*c.* The configuration of cylindrical movable bodies has a perimeter that is approximately the length and shaped of the inner circumference of the movement space 3*c.* The cylindrical movable body may be moved upward or downward within the inside movement space 3*c.* In this embodiment, the upward motion of the movable body 5 is limited by an upper surface 3*d* of the movement space 3*c.* The downward motion of movable body 5 is limited by an upper end surface 4*c* of top portion housing 4.

Integrally formed within the lower portion of the movable body 5 is an O-ring disposing grooved 5*a* wherein an O-ring 6 is positioned and disposed. O-ring 6 may be an elastic member made of rubber or other elastic material. The sizing of O-ring 6 allows it to fit snugly within movable body 5 so that O-ring 6 does not shift against movable body 5.

A pair of penetrating holes 5*b* are provided on movable body 5. Penetrating holes 5*b* extends from the inner room 3*b* to the O-ring disposing groove 5*a.* O-ring 6 covers the lower end portion of penetrating holes 5*b.*

The engraving stylus 7 includes an axis portion 7*a,* a disc-shaped flanged portion 7*b* and a tip portion 7*c.* Disc-shaped flanged portion 7*b* is formed on an upper end portion of the axis portion 7*a.* The tip portion 7*c* is formed on a lower end portion of the axis portion 7*a* and contains a pointed-shaped top end.

The axis portion 7*a* of the engraving stylus 7 is inserted into an insertion hole 4*a* and moves slidably upward and downward within axis portion insertion hole 4*a.*

Helical compression spring 8, which is disposed around axis portion 7*a,* functions as the first energizing means. An upper end portion of the helical compression spring 8 directly contacts with the lower surface of the flanged portion 7*b* of the engraving stylus 7. The lower end portion of the helical compression spring 8 rests upon a lower surface of an engraving stylus operating room 4*b,* which is formed inside of top portion housing 4.

According to the present embodiment, the movable body is energized upward by the expansion of helical compression spring 8 which in turns moves the flanged portion 7*b* of the engraving stylus 7 and O-ring 6 upward. In the embodiment shown in FIG. 1, the movable body 5 is in a stationary state. A peripheral portion of an upper end surface of the movable body 5 is in contact with the upper surface 3*d* of the movement space 3*c.* Further, O-ring 6 is pressed against penetrating holes 5. Therefore, the lower end portion of the inner room 3*b* is hermetically sealed by the movable body 5 and O-ring 6.

Figure 2:
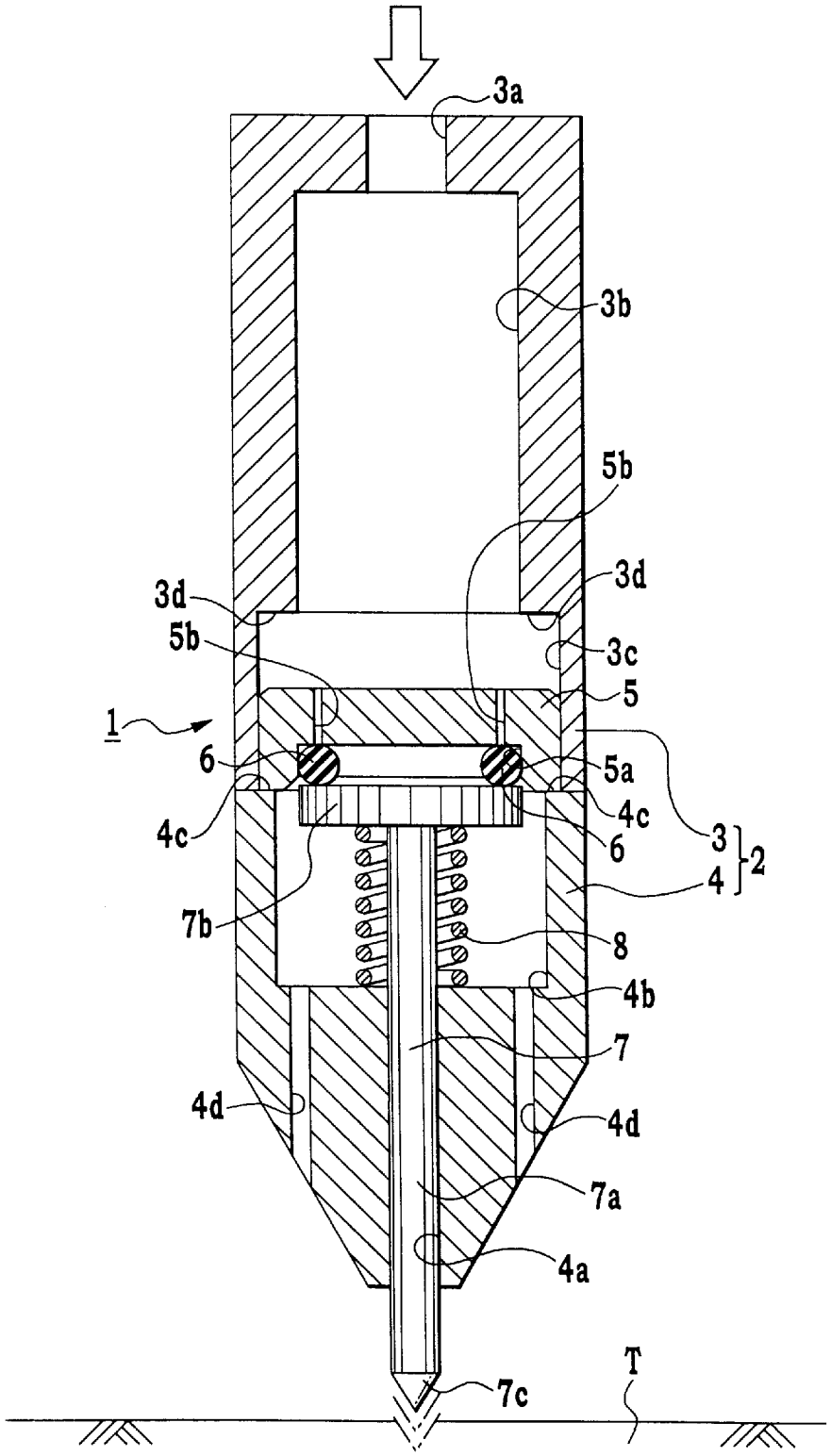
FIG. 2 illustrates a sectional side view of the engraving head in accordance with an embodiment of the present invention.

Referring to FIG. 2, the engraving operations of engraving head 1 according to the present invention will be explained. Initially, the supply of compressed gas from the compressed gas supply port 3*a* is introduced, as indicated by an arrow in FIG. 2, into inner room 3*b.* As the gas pressure of inner room 3*b* increases, the movable body 5 moves downward along the inner circumference of the movement space 3*c* against the energizing force of the helical compression spring 8. The movement of the movable body and O-ring 6 causes engraving stylus 7 to move downward and to approach engraving surface T.

As shown in FIG. 2, when the lower end surface of the movable body 5 encounters the upper end surface 4*c* of the top portion housing 4, the downward movements of the movable body 5, O-ring 6 and the engraving stylus 7 stop. The tip portion 7*c* rests at a position near the engraving surface T of the work piece.

In this state, the compressed gas is continuously supplied from the compressed gas supply port 3*a,* so that the gas pressure within inner room 3*b* continues to increase. When the gas pressure inside inner room 3*b,* that is, the gas pressure applied to O-ring 6 exceeds a predetermined value, the engraving stylus and O-ring 6 moves slightly downward by the pressure of the gas exerted against the energizing force of helical compression spring 8. Small spaces between the O-ring 6 and O-ring disposing groove 5*a* are generate due to the downward motion. These small spaces allow the compressed gas to flow into the engraving stylus operating room 4*b.* Further, the gas discharges from the engraving stylus operating room 4*b* through of a pair of discharge holes 4*d* formed in top portion housing 4.

The gas pressure inside inner room 3*b,* which is under a high pressure until the compressed gas begins to exits top portion housing 4, decreases. Thus, once again, O-ring 6 is energized upward by the expansion of helical compression spring 8 which moves flanged portion 7*b* slightly upwards. Thus, O-ring 6 and engraving stylus 7 are moved slightly upward. Accordingly, O-ring 6 is pressed upward to once again cover penetrating holes 5*b.*

As previously discussed, the gas pressure inside inner room 3*b* increases again. The introduction of the compressed gas generates the intermittent expansion and contraction motion of the helical compression spring, which in turn generates the small up and down movements of O-ring 6 and engraving stylus 7. These small up and down movements are quickly repeated. Thus, it becomes the slight up-and-down vibration of the engraving stylus 7. The slight vibration may have a small amplitude and a large number of vibration frequency. The supply speed of the compressed gas or other conditions are established so that the operation time from the start of the supply of the compressed gas to the start of the vibration of the engraving stylus 7 will be performed within an extremely short time frame.

When the lower end surface of the movable body 5 initially contacts upper end surface 4*c,* tip portion 7*c* of the engraving stylus 7 is positioned nearby engraving surface T of the work piece to be engraved. Then, the engraving stylus 7 moves slightly up and down, as described above, causing tip portion 7*c* to repeatedly strike the engraving surface T, so that recesses or cavities are formed in the engraving surface T.

While the engraving stylus vibrates slightly upward and downward, as discussed above, the engraving head 1 is moved in the X and Y directions by the movement means (which is not shown) connected to the engraving apparatus (which is not shown). Letters, symbols, figures or the like are engraved on the engraving surface T.

In order to produce engravings which are not expressed with a single brush stroke on the engraving surface T, initially, the supply of the compressed gas from the compressed gas supply port is brought to a released state, so that the gas pressure inside of inner room 3*b* decreases.

Then, the slight up-and-down vibration of engraving stylus 7 stops. The movable body 5 moves upward energized by the flanged portion and O-ring 6 due to the expansion of helical compression spring 8. The movable body 5 moves upward until its peripheral portion contacts the upper surface side 3*d* of movement space 3*c*.

The strength of the helical compression spring 8 or the like is set so that the operation time of the stoppage of the supply of the compressed gas to the upward movement of the movable body 5 is performed within an extremely short time period.

During the upward movement of movable body 5, the engraving stylus 7 also moves upward. In other words, the engraving stylus 7 disengages from the engraving surface T and tip portion 7*c* recedes at a sufficient distance from engraving surface T, as shown in FIG. 1.

In this position, engraving head 1 is moved in the X and Y direction to a desired position by a movement means (which is not shown). The compressed gas is once again supplied from the compressed gas supply port 3*a* to inner room 3*b* to form the engravings which are not expressed with a single brush stroke on the engraving surface T.

According to engraving head 1 of the present invention, the operation of the extending and contracting tip portion 7*c* to and from the engraving surface T is not performed by lifting the entire engraving head 1 upward and downward. In contrast, in the present invention this operation is implemented by the relative movement of engraving stylus 7 within body housing 2. Accordingly, it is not required for the engraving apparatus to be provided with an up-and-down movement means, such as a sliding mechanism or an air cylinder, for moving the entire engraving head. Thus, the cost and the size of the engraving apparatus may be reduced.

Furthermore, due to the configuration of the present invention and the usage of the compressed gas, it is possible to rapidly move the movable body 5 in order to position tip portion 7*c* near engraving surface T. When the supply of compressed gas is discontinued, tip portion 7*c* is energized by helical compression spring 8 to immediately separate from engraving surface T. Thus, it is possible to rapidly perform a series of repetitive operations to smoothly produce engravings which are not expressed with a single brush stroke. The series of repetitive steps are: (1) positioning engraving stylus 7 nearby engraving surface T, (2) engraving surface T and (3) disengaging engraving stylus 7 from engraving surface T. With the present invention, these steps are performed smoothly within an extremely short time frame.

It is further noted that the compressed gas can also be used as the power source for making the stylus 7 slightly vibrate.

Although the present invention discloses the movement space as having a cylindrical space because this configuration is preferable in terms of frictional resistance or the like. It will be appreciated that other configurations may be contemplated by the invention. For example, the profile of the movement space may resemble a prismatic shape. Thus, the shape of the movable body may be modified to compliment the shape of the movement space.

Likewise, although the helical compression spring is disclosed as the first energizing means for energizing the movable body away from the engraving surface, it will be appreciated that other types of devices may be employed as the first energizing means.

From the foregoing description, one skilled in the art can easily ascertain the essential characteristics of this invention, and without departing from the spirit and scope thereof, can make various changes and modifications of the invention to adapt it to various usage and conditions.

The entire disclosure of Japanese Patent Application No. 10-237793 filed on Aug. 24, 1998 including the specification, claims, drawings and summary are incorporated herein by reference in its entirety.

What is claimed is:

1. An engraving head, for use with an engraving apparatus, said engraving head comprising:

a body housing, adapted to be mounted to said engraving apparatus, having means for moving the engraving head in a plane which is parallel to an engraving surface of a work piece to be engraved;

an engraving stylus, disposed at a given position with respect to said body housing, having a tip portion for forming recesses in said engraving surface; and a movement mechanism for moving said engraving stylus relative to said body housing along a direction as said tip portion approaches and recedes from said engraving surface, wherein said movement mechanism comprises:

a movable body to limit positions of said engraving stylus, said movable comprising a structure to terminate the movement of said engraving stylus in a first direction at a first non-engraving position and to terminate the movement of said engraving stylus in a second direction at a second vibrating position at which said engraving stylus opposes and is in contact with the engraving surface.

2. The engraving head of claim 1, wherein the movement of said movable body terminates at said second vibrating position, and thereafter said engraving stylus starts to vibrate.

3. The engraving head of claim 2, wherein said movement mechanism comprises:

a first energizing means, provided within said body housing, for exerting a first energizing force to energize said movable body in a direction away from said engraving surface;

a second energizing means, provided within said body housing, for exerting a second energizing force against said movable body in a direction towards said engraving surface and against said energizing force of said first energizing means, causing said engraving stylus and said tip portion to approach said engraving surface;

said body housing and said first and second position limiting members being arranged so as to form a movement space, said movement space having an inner circumference and permitting said movable body to move within said inner circumference; and said movable body receding from said engraving surface when said second energizing force is released, causing said engraving stylus and said tip portion to simultaneously recede from said engraving surface.

4. The engraving head of claim 3, wherein said second energizing means includes compressed gas supplied to said body housing.

5. The engraving head of claim 4, wherein at least one penetrating hole formed in said movable body, for permitting said compressed gas to pass therethrough;

an elastic member, disposed between a flanged portion and said movable body, for covering an exit of said penetrating hole;

a flanged portion coupled to an end portion of said engraving stylus that opposes said tip portion, for supporting said elastic member; and said compressed gas intermittently passing between said exit of said penetrating hole and said elastic member, thereby, generating said vibrations of said engraving stylus.

6. The engraving head of claim 5, wherein said elastic member is disposed in a groove portion formed in said movable body.

7. An engraving head, for use with an engraving apparatus, said engraving head comprising:

a body housing, adapted to be mounted to said engraving apparatus, having means for moving an engraving head in a plane which is perpendicular to said engraving head, said body housing comprising at least two surfaces defining a movement space therebetween the two surfaces;

an engraving stylus, disposed at a given position with respect to said body housing, having a tip portion extending therefrom;

a movement mechanism for moving said engraving stylus relative to said body housing, thereby causing said tip portion to extend and retract and for causing said engraving stylus to vibrate, wherein said movement mechanism comprises:

a movable body to limit positions of said engraving stylus, said movable body slidably positioned at a first non-engraving position and a second vibrating position within said movement space by a first and second energizing means, said first and second position limiting members positioned within said movement space and attached to said body housing;

said first energizing means energizes said movable body along a direction opposite to the direction in which said second energizing means energizes said movable body; and said second energizing means energizes said movable body to move to said second vibrating position so that said movement mechanism enables said engraving stylus to vibrate and produce engravings on said engraving surface.

8. The engraving head of claim 7, wherein the movable body comprises rectangular-shaped ends for registering with rectangular-shaped members formed inside said body housing; and said movable body stopping at said first and second positions located within said movement space when said rectangular-shaped ends registers with said rectangular-shaped ends of said body housing; said second positions located closer to said engraving surface than said first position.

9. The engraving head of claim 8, wherein said second energizing means includes compressed gas;

a penetrating hole, formed within said movable body, for permitting said compressed gas to pass therethrough;

an elastic member, disposed between a flanged portion and said movable body, for covering an exit of said penetrating hole;

a flanged portion coupled to an end portion of said engraving stylus that opposes said tip portion, for supporting said elastic member; and said movement mechanism for moving said movable body relative to said body housing from said first non-engraving position to said second vibrating position to initiate an engraving process, thereafter, said compressed gas intermittently passing between said exit of said penetrating hole and said elastic member to generate said vibrations of said engraving stylus.

10. The engraving head of claim 9, wherein said vibration of said engraving stylus terminates, then, said movement mechanism moves said movable body relative to said body housing from said second vibrating position to said first non-engraving position, thereafter said means for moving said engraving head moves said engraving head to a desired position so that the engraving stylus engraves intermittent lines.

11. An engraving head for use with an engraving apparatus comprising:

a body housing, adapted to be mounted to said engraving apparatus, having a means for moving the engraving head in a plane which is parallel to an engraving surface of a work piece to be engraved;

an engraving stylus, disposed within said body housing, having a tip portion extending therefrom for forming recesses in said engraving surface;

a movement mechanism, disposed within said body housing, for moving said engraving stylus relative to said body housing in directions that said tip portion moves as said tip portion approaches and recedes from said engraving surface;

a movable body provided in said movement mechanism for restricting the movement of said engraving stylus;

a first position limiting member, positioned above said movement mechanism, for terminating the upward movement of said movement mechanism when said movement mechanism contacts said first position limiting member;

a second position limiting member, positioned beneath said movement mechanism, for terminating the downward movement of said movement mechanism when said movement mechanism contacts said second position limiting members;

said movement mechanism slidably disposed between said first position limiting member and said second position limiting member; and said movement mechanism enabling said engraving stylus to vibrate causing said tip portion to strike against said engraving surface to form recesses in said engraving surface, at said second position limiting member, said vibrations of said engraving stylus enables said tip portion to produce engravings on said engraving surface.

* * * * *